United States Patent [19]

Deal

[11] Patent Number: 4,576,187

[45] Date of Patent: Mar. 18, 1986

[54] VARIABLE AIR DILUTION CIGARETTE FILTER

[75] Inventor: Philip A. Deal, Winston-Salem, N.C.

[73] Assignee: R. J. Reynolds Tobacco Company, Winston-Salem, N.C.

[21] Appl. No.: 663,681

[22] Filed: Oct. 22, 1984

[51] Int. Cl.[4] ..... A24D 3/04

[52] U.S. Cl. ..... 131/336; 131/198.2

[58] Field of Search ..... 131/336, 198 R, 198 A

[56] References Cited

U.S. PATENT DOCUMENTS 2,923,647 2/1960 Aghnides ..... 131/336

3,359,988 12/1967 Thomson ..... 131/336

*Primary Examiner*—Vincent Millin

*Attorney, Agent, or Firm*—Grover M. Myers

[57] ABSTRACT

A variable air dilution cigarette filter is disclosed. A thin, generally rigid cylindrical sleeve having internal retention steps or barbs is provided with one or more air passing slots or perforations. A filter rod having a filter wrap is inserted within the cylindrical tube or sleeve and is held within the tube by the retention steps. Relative rotation between the sleeve and the filter rod varies the amount of smoke diluting air which is allowed to pass through the slots in the sleeve and then through the filter rod. A tobacco rod is joined to the sleeve by tipping paper or the like to thereby produce a cigarette incorporating the variable air dilution cigarette filter assembly.

8 Claims, 13 Drawing Figures

VARIABLE AIR DILUTION CIGARETTE FILTER

FIELD OF THE INVENTION

The present invention is directed generally to a cigarette filter. More particularly, the present invention is directed to an air dilution cigarette filter. Most specifically, the present invention is directed to a variable air dilution cigarette filter. A thin, generally rigid sleeve, which has been wrapped with filter paper, overlies a conventional filter rod. The sleeve includes interior steps or threads which retain the filter within the sleeve while permitting rotation between the sleeve and the filter rod. The sleeve includes one or more slots or other air passages such as perforations through which diluting air can pass to the filter rod. Variations in the amount of air flow are achieved by rotation of the sleeve with respect ot the filter rod, thereby allowing the user to select a degree of air dilution in accordance with his personal tastes.

DESCRIPTION OF THE PRIOR ART

The use of various filters with cigarettes generally is well known. When filters initially were applied to cigarettes, they were relatively unsophisticated and consisted of a rod of a filter material secured to one end of a tobacco rod by tipping paper. As the technology has developed, cigarette filters have become more complex and now function to accomplish additional tasks in conjunction with their primary one of removing constituents from the tobacco smoke. One such aim has been the dilution of the tobacco smoke with a quantity of air. This dilution has been accomplished through various means such as the use of perforated filter wraps and tipping papers, the provision of air inlet ports between the tobacco rod and the filter, and other similar means.

A primary objection to air dilution cigarette and filter assemblies has been the lack of an effective means to vary the degree of air dilution. An amount of dilution which is appealing to one consumer may be either too great or too little to another. It may also be the preference of an individual to be able to vary or select a degree of air dilution on a cigarette-to-cigarette or day-to-day basis. Furthermore, personal taste may dictate that the degree of air dilution be varied during the consumption of each cigarette; i.e., minimum dilution when the cigarette is first lit and more dilution as more of the cigarette is smoked.

Prior attempts to provide a variable air dilution cigarette filter has not been particularly successful. The cigarette filter assembly has either been ineffective or unreliable in its means to vary air dilution, has not been convenient or easy for the consumer to use, or has been complex or complicated to manufacture. In a mass-produced, relatively inexpensive article such as a filter cigarette, only a slight increase in manufacturing complexity, time, or costs has a marked effect on the commercial success of the product.

It will thus be appreciated that a need exists for a variable air dilution cigarette filter. Such a filter would be attractive to large numbers of the smoking public yet would be acceptable to those persons who do not wish to use air dilution. However, such a variable air dilution cigarette filter must be uncomplicated, reliable, easy to use, and must not be difficult to manufacture in large quantities and must be suitable for use with presently available cigarette making equipment.

SUMMARY OF THE INVENTION

It is an object of the present invention to provide an air dilution cigarette filter.

Another object of the present invention is to provide a variable air dilution cigarette filter.

A further object of the present invention is to provide a variable air dilution cigarette filter which uses a relatively rotatable filter rod and sleeve.

Yet another object of the present invention is to provide a variable air dilution cigarette filter in which the amount of air dilution can be varied during smoking of the cigarette.

Still a further object of the present invention is to provide a variable air dilution cigarette filter which includes a slotted or perforated sleeve.

As will be discussed in greater detail in the description of preferred embodiments as set forth hereinafter, the variable air dilution cigarette filter, in accordance with the present invention, includes a thin, generally rigid sleeve which overlies a cigarette filter rod. The interior wall of the sleeve is formed with retaining means in the form of either circular steps or helical threads. These allow relative rotation of the sleeve and the filter rod while preventing the two from separating. The sleeve includes one or more slots or perforations in its circumferential wall surface, with these slots or perforations allowing air to pass through the sleeve to the filter rod. Relative rotation between the sleeve and the filter rod varies the amount of air which is allowed to pass thorugh the slots or perforations and into the filter rod. This amount of air dilution is adjustably variable.

The variable air dilution cigarette filter, in accordance with the present invention, allows the user to select the amount of diluting air he desires. This selection can be made before the cigarette is lit and can be varied during smoking of each cigarette. Further, since the cigarette filter assembly is uniform from cigarette to cigarette, the individual smoker can easily adjust each cigarette to the degree of air dilution which he chooses.

For those smokers who do not care to add diluting air to their smoke, the cigarette filter, in according with the present invention, can be set for no air dilution. Cigarettes equipped with the variable air dilution cigarette filter of the present invention can thus be sold to and enjoyed by all smokers whether or not they choose to avail themselves of the variable air dilution feature.

The variable air dilution cigarette filter, in accordance with the present invention, is quite uncomplicated in structure, consisting primarily of a thin walled, generally rigid sleeve or tube having one or more slots or perforations which overlies a conventional filter rod. The unit costs of cigarettes which include the variable air dilution filter is not appreciably higher than the cost of other cigarettes. Further, the filter assembly, in accordance with the present invention, is readily usable with conventional cigarette making equipment. Hence, there is no large additional tooling or equipment costs required to adapt existing machinery to the production of cigarettes which have the subject variable air dilution filter assembly.

It will thus be seen that the variable air dilution cigarette filter, in accordance with the present invention, provides a filter assembly in which the amount of diluting air admitted to the filter is easily and quickly varied. The filter assembly is quite simple in structure and is not complicated or complex. It is usable with presently existing cigarette manufacturing equipment and does not have any appreciable effect on either the time required to make the cigarette nor the cost thereof. The variable air dilution cigarette filter, in accordance with the present invention, satisfies a long-standing need in an uncomplicated and inexpensive manner.

BRIEF DESCRIPTION OF THE DRAWINGS

While the patentable features of the variable air dilution cigarette filter, in accordance with the present invention, are set forth with particularity in the appended claims, a full and complete understanding of the invention may be had by referring to the detailed description of preferred embodiments as set forth hereinafter, and as may be seen in the accompanying drawings in which:

DESCRIPTION OF THE PREFERRED EMBODIMENTS

Figure 1:
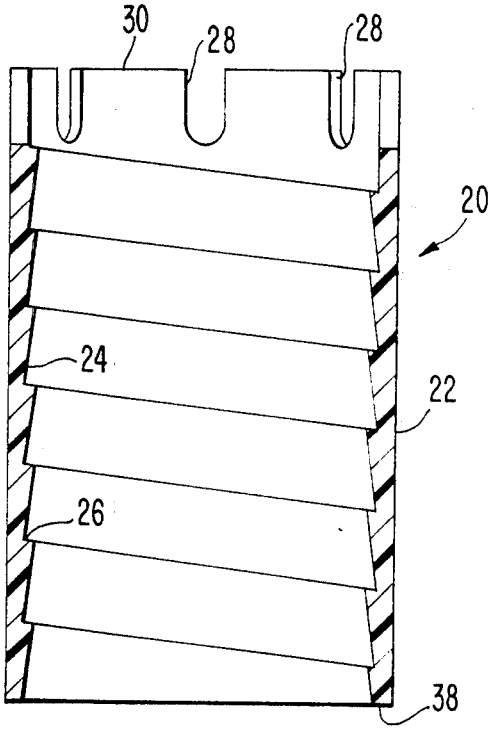
FIG. 1 is a sectional side elevation view of a first preferred embodiment of a variable air dilution cigarette filter sleeve in accordance with the present invention.
Figure 2:
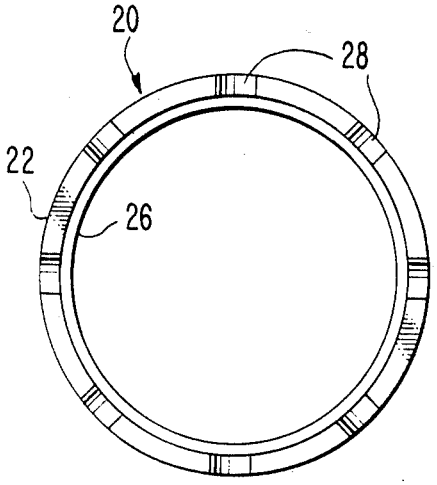
FIG. 2 is an end view of the sleeve of FIG. 1.

Referring initially to FIGS. 1 and 2, there may be seen generally at 20 a first preferred embodiment of a sleeve for a variable air dilution cigarette filter in accordance with the present invention. Sleeve 20 is a thin, generally rigid, cylindrical tube of plastic or another appropriate material. The outer wall surface 22 of tube or sleeve 20 is generally smooth while the inner wall surface 24 is preformed or premolded into a generally helically threaded configuration. These threads are defined by generally inwardly extending steps or barbs 26. As is shown in FIG. 1, the inner wall portion 24 of sleeve 20 slopes gently outwardly from one such sharp step or barb 26 to the next. A plurality of circumferentially spaced, longitudinally extending slots 28 are formed at a first end 30 of tube or sleeve 20. As will be discussed in greater detail subsequently, these slots 30 admit diluting air into the interior of the tube. The pitch of the threaded steps 26 is such that one complete rotation of sleeve 20 through approximately 360° will move the sleeve 20 a longitudinal distance equal to the length of slots 28.

Figure 3:
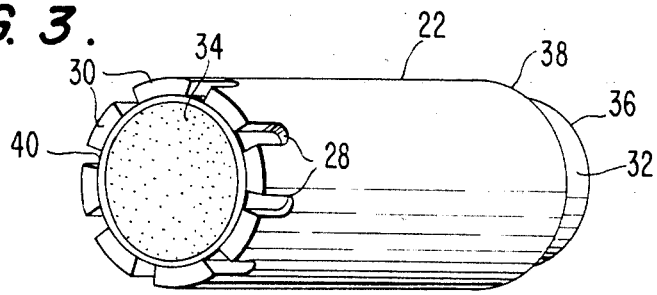
FIG. 3 is a perspective view of the first preferred embodiment of the variable air dilution cigarette filter sleeve overlying a filter rod and placed in the minimum dilution portion.
Figure 4:
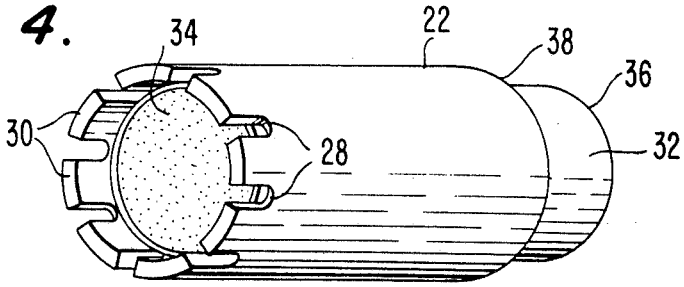
FIG. 4 is a view similar to FIG. 3 and showing the assembly in the maximum dilution position.

A generally conventional filter rod 32 is inserted into sleeve 20, as seen in FIG. 3, until a first end 34 of filter rod 32 is flush with the first end 30 of sleeve 20. A second end 38 of filter rod 32 protrudes for a slight distance beyond a second end 38 of sleeve 20. Filter rod 32 is wrapped with a conventional nonpermeable filter wrap 40 which prevents air flow radially inwardly into the filter through the slots 28 and the filter wrap 40. The filter rod 32 and its encircling filter wrap 40 are forced into sleeve 20 from the right to the left, as seen in FIGS. 3 and 4. In this way the rod 32 slides easily over the gently sloped interior faces 24 of sleeve 20. The rod 32 is sized so that it compresses slightly as it is pushed into sleeve 20. Once rod 32 has been inserted into sleeve 20, the steps or barbs 26 function as retaining means to retain the rod 32 within the sleeve and prevent its easy withdrawal. As was indicated previously, the thread pitch of steps 26 is selected so that a 360° relative rotation of sleeve 20 and fitter rod 32 will vary the position of the sleeve 20 with respect to the filter rod 32 a distance equal to the length of the slots 28. Such movement of the sleeve 20 with respect to the filter rod 32 can be seen in FIG. 4 wherein it will be noted that the first end 34 of filter rod 32 is shown as being retracted within the sleeve 20 so that it is positioned adjacent the ends of slot 28 from first end wall 30 of sleeve 20.

Figure 5:
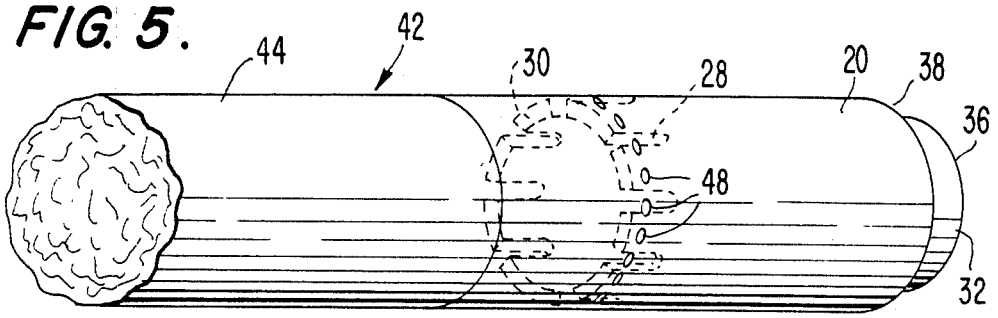
FIG. 5 is a view similar to FIG. 3 and showing a tobacco rod joined to the first preferred embodiment of the variable air dilution cigarette filter of the present invention.

Turning now to FIG. 5, a cigarette, generally at 42, which uses the first preferred embodiment of sleeve 20 to form a variable air dilution cigarette may be seen. A conventional paper wrapped tobacco rod 44 is positioned abutting the first end 30 of sleeve 20 and the two are jointed together by a encircling band of tipping paper 46. The tipping paper 46 is provided with a plurality of holes or perforations 48 that are formed by conventional means in a circumferential ring which overlies slots 28 on sleeve 20. Tipping paper 46 can overlie the entire sleeve 20 or just the slotted portion thereof. However, tipping paper 46 should not extend beyond the second end 38 of sleeve 20, thereby leaving the second end 36 of filter rod 32 accessible.

When the sleeve 20, filter rod 32, and the tobacco rod 44 are in the position shown in FIGS. 3 and 5, there is no air dilution as the tobacco rod abuts the first end 34 of filter rod 32. Since the filter wrap 40 is nonpermeable to air, no air can pass through the slots 38 and into the filter rod 32 since the filter wrap acts as a barrier. In order to provide air dilution, it is necessary only to rotate the sleeve 20 relative to filter rod 32. This is easily accomplished by turning the second end 36 of filter rod 32 while holding sleeve 20 stationary. The threaded steps or barbs 26 on the inner wall 24 of sleeve 20 will cause the rod 32 to move relative to the sleeve 20 in a manner as seen in FIG. 4. Since the tobacco rod 44 is joined to sleeve 20 but not to the first end face 34 of filter rod 32, movement of filter rod 32 within sleeve 20 will create a chamber or space between the end of tobacco rod 44 and the first end 34 of rod 32. Air can not flow through slots 28 in sleeve 20 into this space and into filter rod 32 through first end 34 thereof. Air dilution of the smoke is thus provided. By varying the amount of the length of slots 28 which extend beyond the first end 34 of filter rod 32, the amount of air admitted to filter rod 32 can be varied. Thus air dilution is quickly and easily varied merely by rotation of filter rod 32 within sleeve 20.

Figure 6:
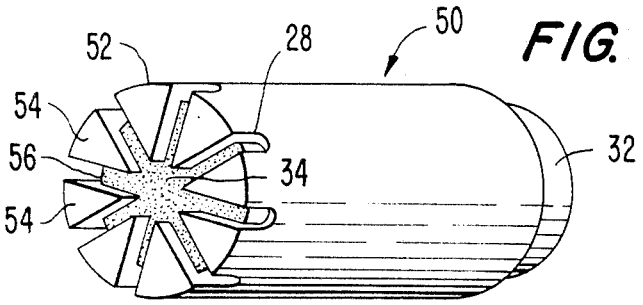
FIG. 6 is a perspective view of a second preferred embodiment of a variable air dilution cigarette filter in accordance with the present invention.

A second preferred embodiment of a sleeve, generally at 50, for a variable air dilution cigarette filter may be seen by turning to FIG. 6. Sleeve 50 is generally the same as sleeve 20 and, although not shown, includes helical steps or barbs which act as a retaining means for filter rod 32. The difference between the first preferred embodiment 20 of the sleeve and the second preferred embodiment 50 is that in the second embodiment some air dilution is always present. Slots 28 are formed in the sleeve 50 in a manner similar to sleeve 20. However, the sleeve 50 of the second preferred embodiment has a first end 52 formed as a plurality of radially inwardly extending, triangular segments 54. These segments are separated from each other by channels 56 which overlie the first end 34 of filter rod 32. Thus, when the sleeve 50 is joined to a tobacco rod 33 by perforated tipping paper 46 in a manner similar to that shown in FIG. 5, the channels 56 allow the flow of diluting air to filter rod 32 even when the sleeve is in the minimum dilution position; i.e., with the first end 34 of filter rod 32 abutting the inner surfaces of the triangular segments 54 of sleeve 50, as seen in FIG. 6. As with the first preferred embodiment, air dilution can be increased with sleeve 50 by relative rotation of sleeve 50 with respect to filter rod 32, thereby moving rod 32 within sleeve 20 in a manner similar to that previously discussed with respect to the first preferred embodiment 20.

Figure 7:
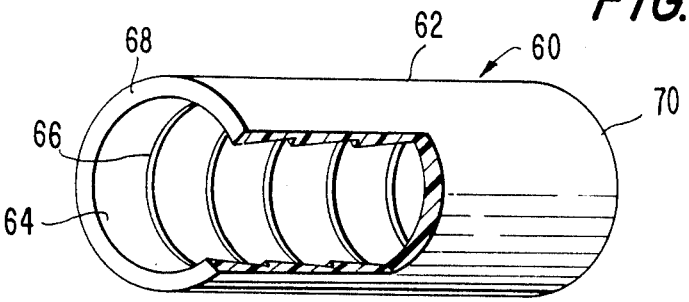
FIG. 7 is a perspective view, partly in section, of a third preferred embodiment of a variable air dilution cigarette filter sleeve in accordance with the present invention.

Turning now to FIG. 7, there may be seen a third preferred embodiment of a sleeve, generally at 60, for use in a variable air dilution cigarette filter in accordance with the present invention. As with the two previously described preferred embodiments, sleeve 60 is a generally rigid, thin walled cylindrical tube having a smooth outer wall 62 and an inner wall 64. Inner wall 64 is preformed or premolded with a plurality of steps or barbs 66 which act as retaining means in a manner similar to the helical steps or barbs 26 of the sleeves 20 and 50 of the first and second preferred embodiments respectively. Steps or barbs 66 of the third preferred embodiment 60, in contrast to those of the first and second embodiment, are annular and do not form threads but instead follow a circular path about the interior 64 of sleeve 60.

Figure 8:
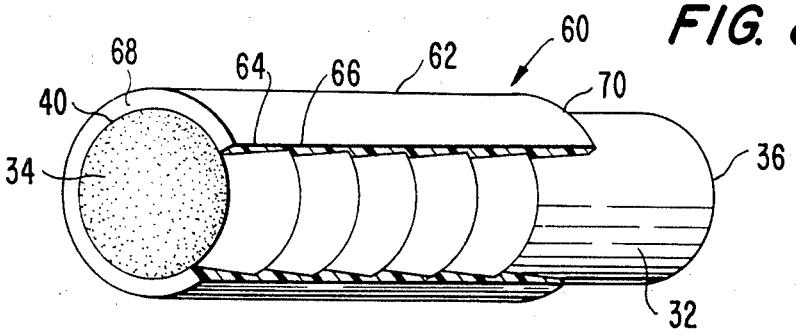
FIG. 8 is a view similar to FIG. 7 and showing the sleeve overlying a filter rod.

A filter rod 32, having a nonpermeable filter wrap 40, may be slid into the interior of sleeve 60 as may be seen in FIG. 8. Filter rod 32 is slid into sleeve 60 from the right to the left, as viewed in FIG. 8, until a first end 34 of rod 32 is adjacent a first end 68 of sleeve 60. A second end 36 of filter rod 32 extends to the right of a second end 70 of sleeve 60 in a manner similar to that previously discussed with respect to sleeves 20 and 50. Filter rod 32 has a slightly larger outer diameter than the inner diameter of sleeve 60 so that the filter rod 32 is slightly compressed as it is inserted in sleeve 60. As may be seen in FIG. 8, the circular steps or barbs 66 form retaining means which allow relative rotational movement between sleeve 60 and filter rod 32 but which prevent longitudinal slippage between the two.

Figure 9:
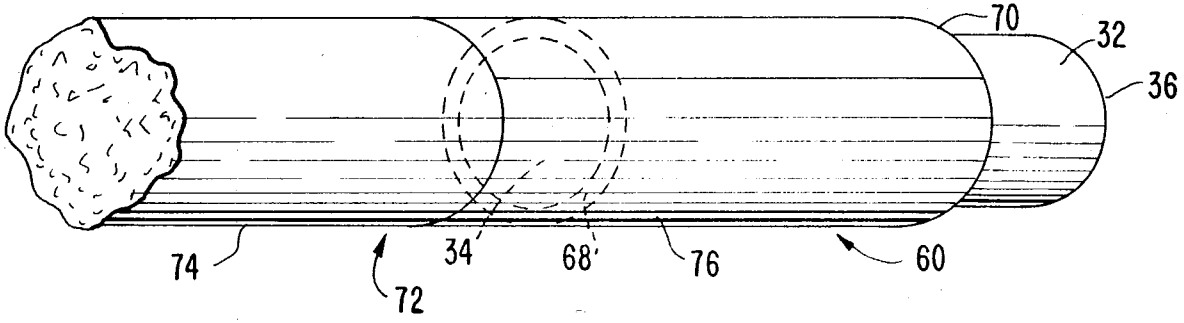
FIG. 9 is a perspective view of the third preferred embodiment of the variable air dilution cigarette filter sleeve attached to a tobacco rod.
Figure 10:
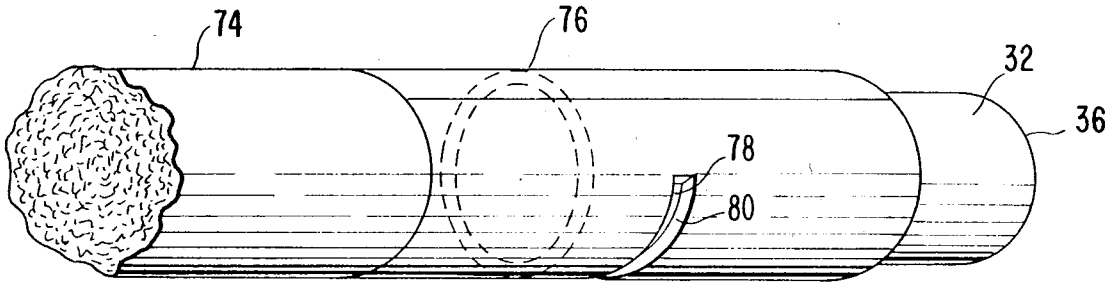
FIG. 10 is a perspective view generally similar to FIG. 9 and showing a first alternative variable air dilution cigarette filter using the third preferred sleeve embodiment with the filter being shown in the maximum dilution position.
Figure 11:
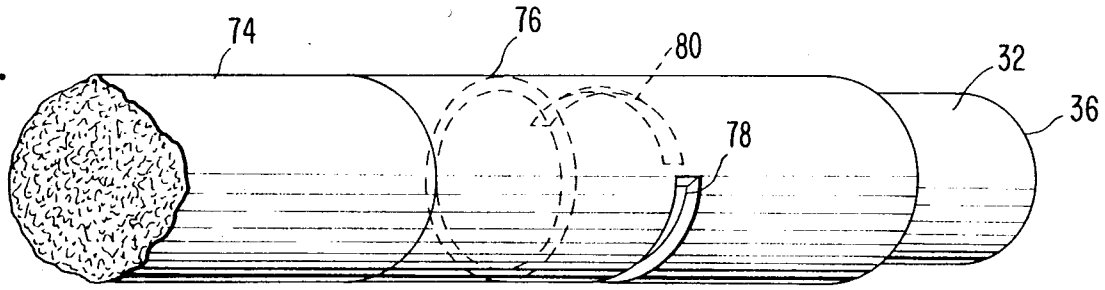
FIG. 11 is a view similar to FIG. 10 and showing the cigarette filter in the minimum dilution position.
Figure 12:
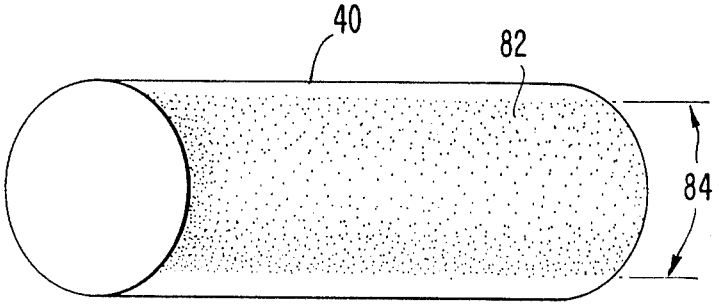
FIG. 12 is a perspective view of a filter rod for use in a second alternative variable air dilution cigarette filter using the third preferred sleeve embodiment.

A cigarette assembly 72 is shown in FIG. 9 in which a paper wrapped tobacco rod 74 is joined to the first end 68 of sleeve 60 by an overlying wrapping of tipping paper 76, all in a manner similar to that previously described in conjunction with the first preferred embodiment. Subsequent to the application of tipping paper 76 to sleeve 60 and tobacco rod 74, a slot 78 is cut through tipping paper 76, sleeve 50 and a corresponding slot 80 is concurrently formed in the nonpermeable filter wrap 40 overlying filter rod 32. This slot is shown in FIG. 10 and allows diluting air to pass into the filter rod 32, thereby diluting the smoke as it passes through the filter. When the slot 78 in the sleeve 60 is fully aligned with the slot 80 formed in the filter wrap 40, as seen in FIG. 10, the variable air dilution cigarette filter is in the maximum dilution position. Dilution may be reduced from this maximum position by relative rotation of filter rod 32 within sleeve 60. This will move slot 78 in tipping paper 76 and sleeve 60 out of alignment with the slot 80 formed in the filter wrap 40. As the degree of overlap of the slots decreases, the amount of air dilution also decreases. No air dilution occurs when the slot 80 in the filter wrap 40 has been moved completely out of alignment with slot 78 in the sleeve 60, as may be seen in FIG. 11. It should be recalled that relative rotation of sleeve 60 and filter rod 32 is afforded by circular steps or barbs 66 which form retaining means that prevent longitudinal sliding movement of the filter rod 32 in the sleeve 60 while allowing relative rotational movement between the two.

Figure 13:
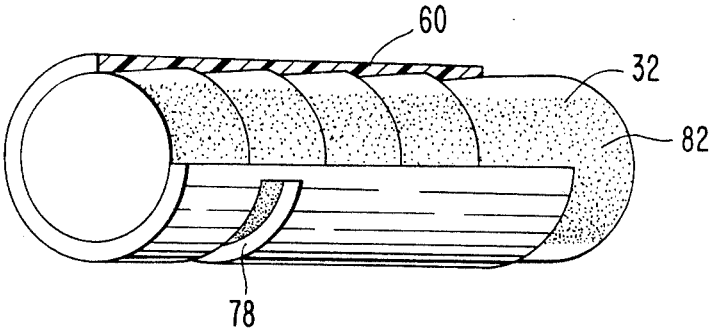
FIG. 13 is a perspective view, partly in section and showing the filter rod of FIG. 12 positioned within the third preferred sleeve embodiment.

In this first alternative variable air dilution cigarette filter utilizing the third preferred embodiment of the sleeve 60, the filter wrap 40 was recited as being nonpermeable and was provided with a slot 80. In a second alternative, the filter wrap 40 may be provided with a zone of permeability or porosity 82 which, as may be seen in FIG. 8, extends about a portion 84 of the filter wrap 40. This permeable portion 84 should not extend more than generally about 180° around the circumference of filter rod 32. In this second alternative variable air dilution cigarette filter utilizing the third preferred embodiment of sleeve 60, the sleeve 60 may be provided with slot 78 prior to its placement over filter rod 32. As seen in FIG. 13, if the slot 78 in sleeve 60 completely overlies porous zone 82 of filter rod 32, air dilution is at a maximum. This air dilution can be varied by relative rotation between sleeve 60 and filter rod 32 until slot 78 in sleeve 60 completely overlies the nonpermeable portion of filter wrap 40 so that no air dilution occurs. It will be apparent that a porous tipping paper must be used with the filter shown in FIG. 13 to allow air to pass through the tipping paper 76 and through slot 78 if the tipping paper 76 overlies slot 78. If tipping paper 76 is not porous, then it must be cut or slit to allow air to pass therethrough and through slot 78.

The three preferred embodiments of a variable air dilution cigarette filter, in accordance with the present invention, all utilize a slotted or perforated, thin, generally rigid, cylindrical tube or sleeve which is rotatable with respect to, and retained on a filter rod to effect variable air dilution. Relative rotation of the sleeve and the filter rod which it is carried by effect an variation in the amount of diluting air that is allowed to pass into the filter rod for mixture with the tobacco smoke. The variable air dilution filter in accordance with the present invention is simple, inexpensive, and is capable of being manufactured and applied to tobacco and filter rods using currently available machinery. It satisfies consumer needs by providing a single cigarette filter assembly which can be used by smokers who want no air dilution and smokers who want a high degree of air dilution. The large numbers of smokers whose tastes lie between these two extremes will find that the filter assembly, in accordance with the present invention, satisfies their needs.

While preferred embodiments of the variable air dilution cigarette filter, in accordance with the present invention, have been fully and completely set forth hereinabove, it will be obvious to one of skill in the art that a number of changes in, for example, the material used for the sleeve, the pattern of the interior barbs within the sleeve, the composition of the filter rod, the types of tipping paper and the like may be made without departing from the true spirit and scope of the invention which is, accordingly, to be limited only by the following claims.

What is claimed is:

1. A variable air dilution cigarette filter assembly for attachment to a tobacco rod to form a variable air dilution cigarette, said filter assembly comprising:

a thin, generally rigid cylindrical sleeve having at least one air slot passing through a circumferential wall of said sleeve;

a filter rod positioned within said sleeve;

retention means in said sleeve, including a plurality of radially inwardly-extending steps on an inner wall of said sleeve, for retaining said filter rod within said sleeve while allowing rotation between said sleeve and said filter rod; and means for varying dilution air flow through said air slot to said filter rod in response to relative rotation of said sleeve and said filter rod.

2. The variable air dilution cigarette filter of claim 1 wherein said steps are a plurality of annular rings.

3. The variable air dilution cigarette filter of claim 1 wherein said steps are a helical thread on said inner wall of said sleeve.

4. The variable air dilution cigarette filter of claim 3 wherein relative rotation of said sleeve and said filter rod to effect longitudinal movement between said sleeve and said filter rod causes a change in the amount of said diluting air passing through said slot to said filter rod.

5. The variable air dilution cigarette filter of claim 4 wherein a plurality of said slots extend longitudinally along said sleeve from a first end thereof.

6. The variable air dilution cigarette filter of claim 5 wherein said first end of said sleeve is joined to said tobacco rod and, further, wherein said relative rotation of said sleeve and said filter rod to increase air dilution moves said slots out of overlying relation with said filter rod and forms a chamber between said juncture of said tobacco rod and said sleeve.

7. The variable air dilution cigarette filter in accordance with claim 6 wherein maximum air dilution is afforded when said slots in said sleeve completely overlie said chamber.

8. The variable air dilution cigarette filter of claim 7 wherein relative rotation of said sleeve and said filter rod through generally about 360° effects longitudinal movement of said sleeve with respect to said filter rod a distance equal to the length of said slots.

* * * * *